US011143184B2

(12) United States Patent
Takai et al.

(10) Patent No.: US 11,143,184 B2
(45) Date of Patent: Oct. 12, 2021

(54) SCROLL COMPRESSOR, REFRIGERATION CYCLE APPARATUS, AND SHELL

(71) Applicant: Mitsubishi Electric Corporation, Tokyo (JP)

(72) Inventors: Akihito Takai, Tokyo (JP); Tomokazu Matsui, Tokyo (JP); Shuhei Koyama, Tokyo (JP); Fumihiko Ishizono, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 219 days.

(21) Appl. No.: 16/337,054

(22) PCT Filed: Oct. 28, 2016

(86) PCT No.: PCT/JP2016/082030
§ 371 (c)(1),
(2) Date: Mar. 27, 2019

(87) PCT Pub. No.: WO2018/078787
PCT Pub. Date: May 3, 2018

(65) Prior Publication Data

US 2020/0025200 A1 Jan. 23, 2020

(51) Int. Cl.
*F04C 18/08* (2006.01)
*F04C 18/02* (2006.01)
(Continued)

(52) U.S. Cl.
CPC ..... *F04C 18/0215* (2013.01); *F04C 18/0261* (2013.01); *F04C 23/008* (2013.01);
(Continued)

(58) Field of Classification Search
CPC ..... F04C 18/0215; F04C 18/0261; F04C 18/0253; F04C 2230/231; F01C 21/10
See application file for complete search history.

(56) References Cited

U.S. PATENT DOCUMENTS 4,548,556 A 10/1985 Terauchi
2002/0192094 A1 12/2002 Milliff et al.
(Continued)

FOREIGN PATENT DOCUMENTS

CN 1374458 A 10/2002
CN 105121855 A 12/2015
(Continued)

OTHER PUBLICATIONS

Office Action dated Apr. 22, 2020 issued in corresponding CN patent application No. 201680090311.9 (and English translation).
(Continued)

*Primary Examiner* — Deming Wan
(74) *Attorney, Agent, or Firm* — Posz Law Group, PLC

(57) ABSTRACT

A scroll compressor includes a frame holding an orbiting scroll configured to slide, a fixed scroll configured to form a compression chamber together with the orbiting scroll, and a shell accommodating the frame and the fixed scroll. The shell includes a first inner wall surface and a first protrusion protruding from the first inner wall surface to position the fixed scroll, and the fixed scroll is fixed to the first inner wall surface.

18 Claims, 9 Drawing Sheets

(51) Int. Cl.

| | |
|---|---|
| ***B23P 11/00*** | (2006.01) |
| ***F01C 20/10*** | (2006.01) |
| *F04C 23/00* | (2006.01) |
| *F04C 29/02* | (2006.01) |

(52) U.S. Cl.
CPC ..... *F04C 29/028* (2013.01); *F04C 2240/30* (2013.01); *F04C 2240/806* (2013.01)

(56) References Cited

U.S. PATENT DOCUMENTS

2006/0051227 A1* 3/2006 Tarng ..... F04C 18/0215 418/55.5
2011/0091341 A1* 4/2011 Zamudio ..... F04C 18/0215 418/55.1
2012/0251369 A1* 10/2012 Watanabe ..... F04C 29/12 418/55.1
2013/0017114 A1* 1/2013 Nakamura ..... F04C 29/0071 418/209
2013/0209305 A1* 8/2013 Takei ..... F04C 18/0253 418/55.3
2013/0302197 A1* 11/2013 Ginies ..... F04C 18/0215 418/55.1
2014/0086776 A1* 3/2014 Park ..... F16C 33/201 418/55.1
2014/0123693 A1* 5/2014 Shimazu ..... F25B 49/02 62/115
2014/0216102 A1* 8/2014 Ignatiev ..... F04C 18/0215 62/468
2015/0159652 A1* 6/2015 Yamazaki ..... F04C 29/0021 418/55.5
2015/0198159 A1* 7/2015 Yamashita ..... F04C 23/008 418/55.1
2020/0032796 A1* 1/2020 Takai ..... F04C 18/0215

FOREIGN PATENT DOCUMENTS

| | | | |
|---|---|---|---|
| JP | S59-224490 | A | 12/1984 |
| JP | H02-005779 | A | 1/1990 |
| JP | H02-140481 | A | 5/1990 |
| JP | H03-074588 | A | 3/1991 |
| JP | 2006-241993 | A | 9/2006 |
| JP | 2013-238142 | A | 11/2013 |
| JP | 6038287 | B2 | 12/2016 |

OTHER PUBLICATIONS

Office Action dated Nov. 1, 2019 issued in corresponding CN patent application No. 201680090311.9 (and English translation).
International Search Report of the International Searching Authority dated Jan. 24, 2017 for the corresponding international application No. PCT/JP2016/082030 (and English translation).

* cited by examiner

SCROLL COMPRESSOR, REFRIGERATION CYCLE APPARATUS, AND SHELL

CROSS REFERENCE TO RELATED APPLICATION

This application is a U.S. national stage application of International Application No. PCT/JP2016/082030, filed on Oct. 28, 2016, the contents of which are incorporated herein by reference.

TECHNICAL FIELD

The present invention relates to a fixing structure of a fixed scroll in a scroll compressor.

BACKGROUND

In a scroll compressor, an orbiting scroll is supported on a frame fixed inside a shell, and a fixed scroll is provided facing the orbiting scroll. A crankshaft is attached to the orbiting scroll, and by rotating this crankshaft, the orbiting scroll makes an orbiting motion adjacent to the fixed scroll, so that the orbiting scroll and the fixed scroll compress refrigerant in a compression chamber formed by the orbiting scroll and the fixed scroll (e.g., see Patent Literature 1).

PATENT LITERATURE

Patent Literature 1: Japanese Unexamined Patent Application Publication No. 2013-238142

In a scroll compressor of Patent Literature 1, a peripheral wall of the frame extends in the direction to the fixed scroll, and the fixed scroll is fixed to the tip of the peripheral wall with a bolt or other fixing objects. As the compression chamber for compressing refrigerant is formed between the fixed scroll and the orbiting scroll, the positional accuracy of the fixed scroll to the orbiting scroll is important, and fixing the fixed scroll to the tip of the peripheral wall of the frame has been required to ensure the positional accuracy.

SUMMARY

The present invention has been made to solve the problem as described above, and it is an object of the present invention to provide a scroll compressor, a refrigeration cycle apparatus, and a shell, capable of disposing a fixed scroll in a shell with positional accuracy without forming a peripheral wall for fixing the fixed scroll to a frame.

A scroll compressor according to one embodiment of the present invention includes a frame holding an orbiting scroll configured to slide, a fixed scroll configured to form a compression chamber together with the orbiting scroll, and a shell accommodating the frame and the fixed scroll. The shell includes a first inner wall surface and a first protrusion protruding from the first inner wall surface to position the fixed scroll, and the fixed scroll is fixed to the first inner wall surface.

According to one embodiment of the present invention, it is possible to dispose a fixed scroll in a shell with positional accuracy without forming a peripheral wall for fixing the fixed scroll to the frame.

DETAILED DESCRIPTION

Hereinafter, one embodiment of the present invention will be described with reference to the drawings. Note that the same or corresponding portion in each drawing is provided with the same reference sign and the description of the portion will be omitted or simplified as appropriate. Further, the shape, size, arrangement, and other elements of a configuration drawn in each drawing can be changed as appropriate within the scope of the present invention.

Embodiment 1

Figure 1:
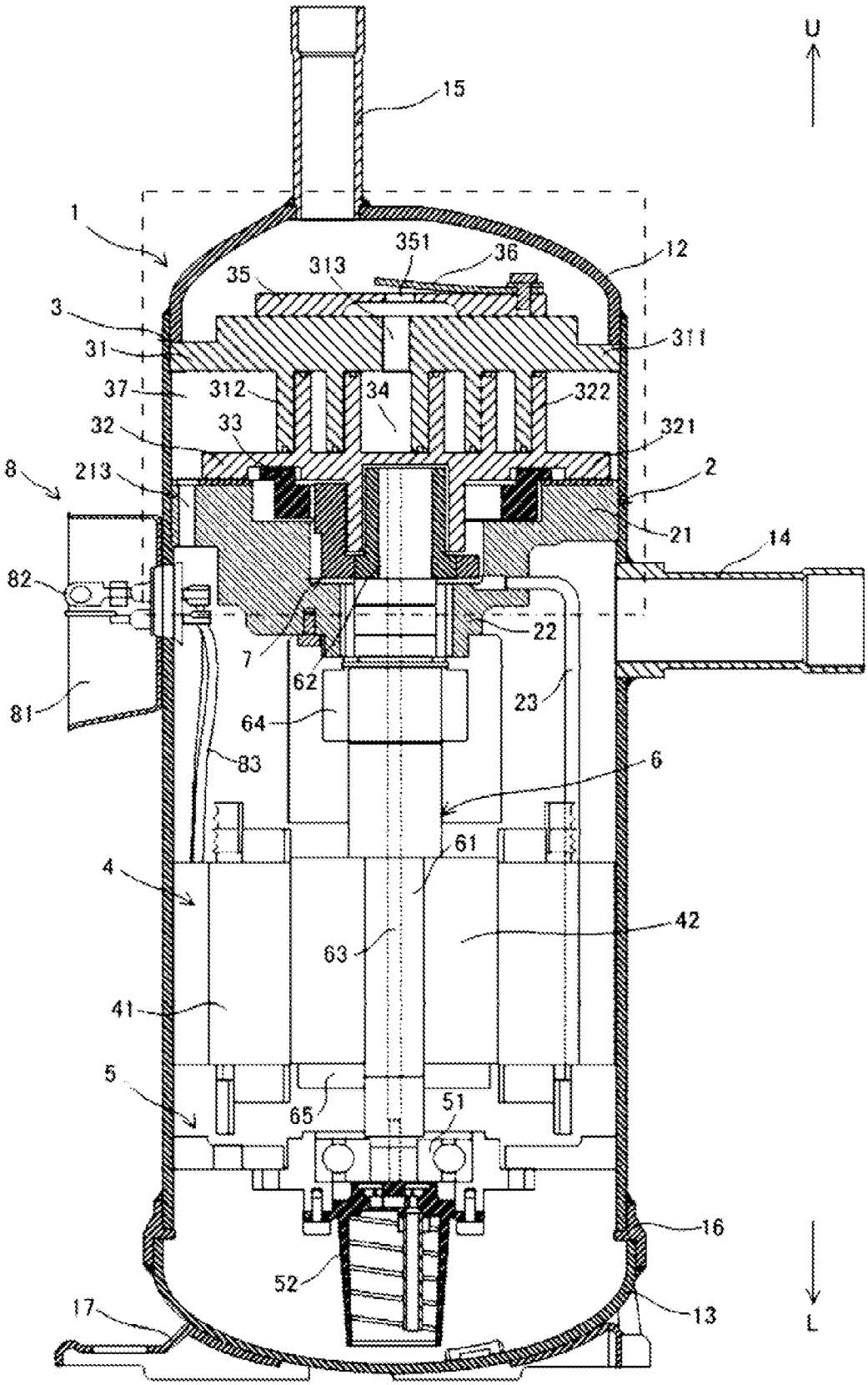
FIG. 1 is a vertical schematic sectional view of a scroll compressor according to Embodiment 1 of the present invention.
Figure 2:
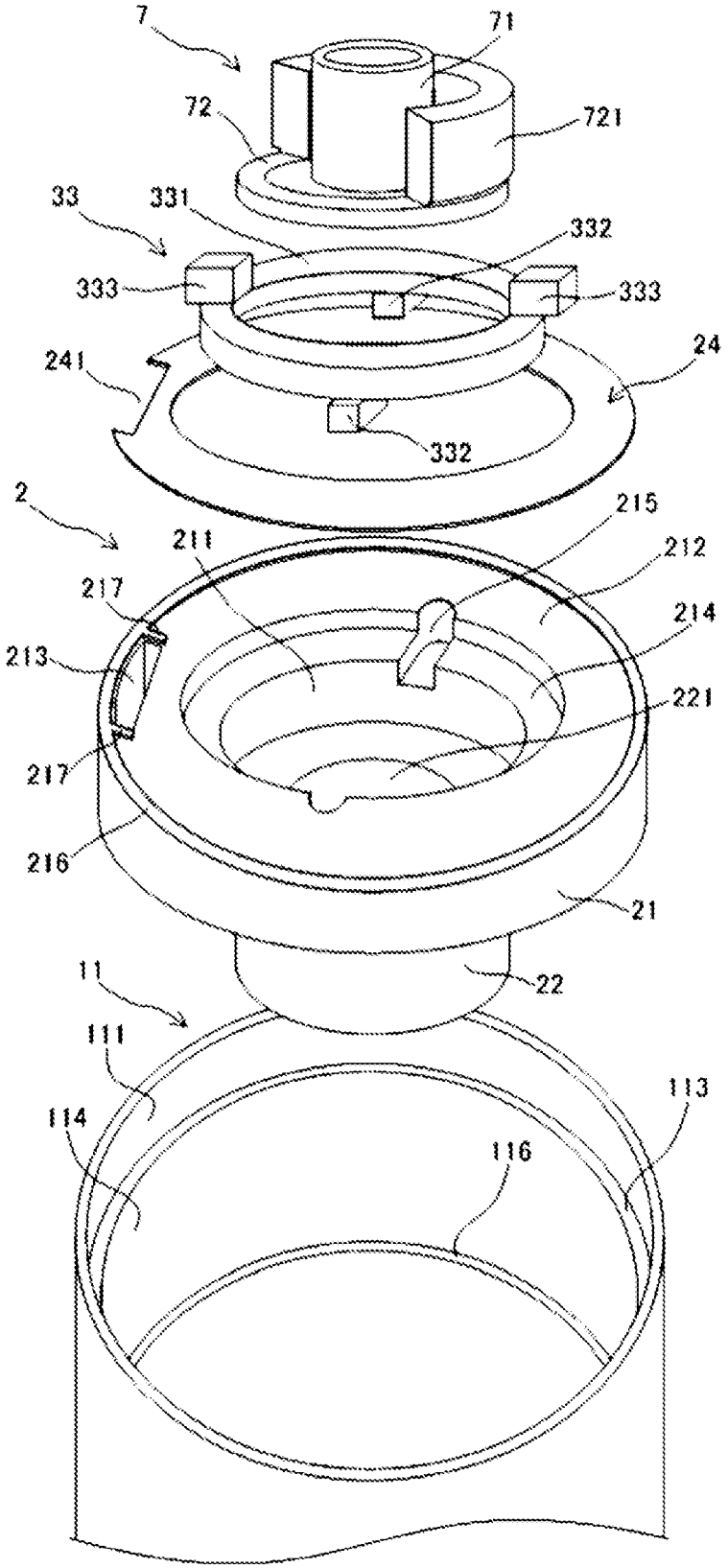
FIG. 2 is an exploded perspective view of a main frame, an orbiting scroll, and other parts of the scroll compressor according to Embodiment 1 of the present invention.
Figure 3:
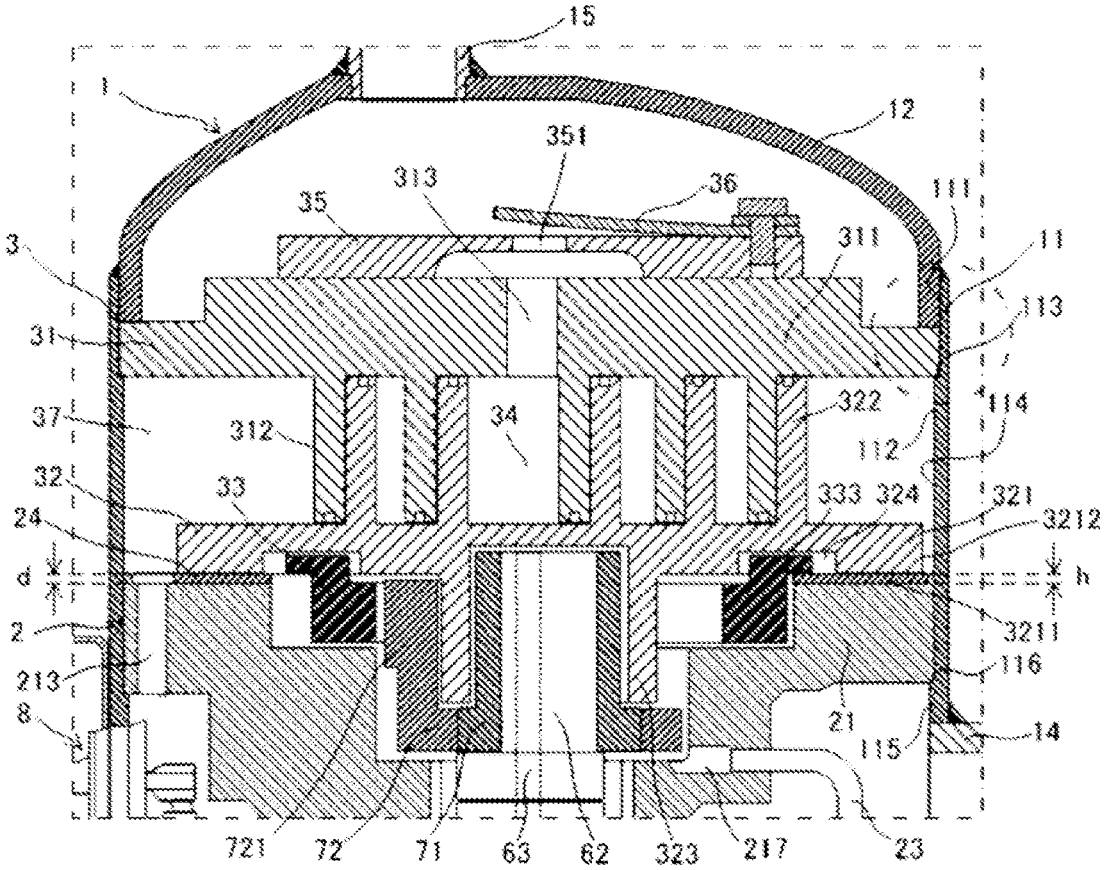
FIG. 3 is an enlarged view of a region indicated by a one-dot chain line in FIG. 1.

Embodiment 1 will be described below. FIG. 1 is a vertical schematic sectional view of a scroll compressor according to Embodiment 1 of the present invention. FIG. 2 is an exploded perspective view of a main frame, an orbiting scroll, and other parts of the scroll compressor according to Embodiment 1 of the present invention. FIG. 3 is an enlarged view of a region indicated by a one-dot chain line in FIG. 1. Note that the compressor in FIG. 1 is a vertical scroll compressor that is used in a state where a central axis of a crankshaft is substantially vertical to the ground.

The scroll compressor is provided with a shell 1, a main frame 2, a compression mechanism unit 3, a driving mechanism unit 4, a sub-frame 5, a crankshaft 6, a bush 7, and a power supply unit 8. Hereinafter, a description will be given to a case where a side (upper side) on which the compression mechanism unit 3 is provided is defined as one end side U and a side (lower side) on which the driving mechanism unit 4 is provided is defined as the other end side L across the main frame 2.

The shell 1 is a cylindrical casing made of a conductive substance such as metal, with both ends closed, and, includes a main shell 11, an upper shell 12, and a lower shell 13. The main shell 11 is formed in cylindrical shape and has a side wall connected with a suction pipe 14 by welding or other methods. The suction pipe 14 is a pipe for introducing refrigerant into the shell 1 and communicates with the inside of the main shell 11. The upper shell 12 is a first shell formed in a substantially hemispherical shape, a part of a side wall of the upper shell 12 is connected at the upper end portion of the main shell 11 by welding or other methods, and the upper shell 12 covers an upper opening port of the main shell 11. A discharge pipe 15 is connected to an upper portion of the upper shell 12 by welding or other methods. The discharge pipe 15 is a pipe for discharging refrigerant to the outside of the shell 1 and communicates with an internal space of the main shell 11. The lower shell 13 is a second shell formed in a substantially hemispherical shape, a part of a side wall of the lower shell 13 is connected at the lower end portion of the main shell 11 with the aid of a coupling shell 16 by welding or other methods, and the lower shell 13 covers a lower opening port of the main shell 11. Note that the shell 1 is supported by a fixing stage 17 provided with a plurality of screw holes. The plurality of screw holes are provided to the fixing stage 17, and by screwing screws into those screw holes, the scroll compressor can be fixed to other parts such as a casing of an outdoor unit.

The main frame 2 is a hollow metal frame with a hollow provided in the metal frame and is provided inside the shell 1. The main frame 2 includes a main body 21, a main bearing portion 22, and an oil returning pipe 23. The main body 21 is fixed to the inner wall surface on the one end side U of the main shell 11, and at the center of the main body 21, an accommodating space 211 is provided along a longitudinal direction of the shell 1. The accommodating space 211 has one end side U opened and is defined in a stepped shape in which the space is narrowed toward the other end side L. An annular flat surface 212 is formed on the one end side U of the main body 21 to surround the accommodating space 211. A ring-shaped thrust plate 24, made of a steel-plate material such as valve steel, is disposed on the flat surface 212. In the present embodiment, the thrust plate 24 acts as a thrust bearing. Further, a suction port 213 is formed in a position not overlapping the thrust plate 24 on the outer edge portion of the flat surface 212. The suction port 213 is a space that extends through the main body 21 in a vertical direction, namely between a part of the main body 21 close to the upper shell 12 and a part of the main body 21 close to the lower shell 13. The number of the suction ports 213 is not limited to one, but more than one suction port 213 may be formed.

An Oldham accommodating portion 214 is formed in the stepped portion closer to the other end side L than is the flat surface 212 of the main frame 2. A first Oldham groove 215 is formed in the Oldham accommodating portion 214. A part of the outer end side portion of the first Oldham groove 215 is formed to scrape a part of the inner end portion of the flat surface 212. Hence a part of the first Oldham groove 215 overlaps the thrust plate 24 when the main frame 2 is seen from the one end side U. A pair of the first Oldham grooves 215 is formed to face each other. The main bearing portion 22 is formed continuously to the other end side L of the main body 21, and a shaft hole 221 is provided inside the main bearing portion 22. The shaft hole 221 extends vertically through the main bearing portion 22, and the one end side U of the shaft hole 221 communicates with the accommodating space 211. The oil returning pipe 23 is a pipe for returning lubricating oil, collected in the accommodating space 211, to an oil reservoir inside the lower shell 13, and is inserted and fixed into an oil discharging hole that extends through the main frame 2 between the inside and the outside.

The lubricating oil is, for example, refrigerating machine oil including ester-based synthetic oil. The lubricating oil is reserved in a lower portion of the shell 1, namely the lower shell 13, and the lubricating oil is suctioned by an oil pump 52 described later, passes through an oil passage 63 in the crankshaft 6, to reduce friction between parts mechanically in contacts in the compression mechanism unit 3 or other units, adjust a temperature of a sliding portion, and improve sealing properties. The lubricating oil is preferably oil having moderate viscosity and being excellent in lubricating characteristics, electric insulation properties, stability, refrigerant solubility, low-temperature flowability, and other properties.

The compression mechanism unit 3 is a compression mechanism for compressing refrigerant. The compression mechanism unit 3 is a scroll compression mechanism including a fixed scroll 31 and an orbiting scroll 32. The fixed scroll 31 is made of metal such as cast iron and provided with a first substrate 311 and a first spiral body 312. The first substrate 311 is formed in a disk shape, and a discharge port 313 formed extending vertically through at the center of the first substrate 311. The first spiral body 312 protrudes from the surface on the other end side L of the first substrate 311 and forms a spiral wall, and the tip of the first spiral body 312 protrudes toward the other end side L. The orbiting scroll 32 is made of metal such as aluminum and provided with a second substrate 321, a second spiral body 322, a cylindrical portion 323, and a second Oldham groove 324. The second substrate 321 is formed in a disk shape having one surface on which the first spiral body 312 is formed, the other surface on which at least a part of an outer peripheral region is a sliding surface 3211, and a side surface 3212 located in a radially outermost portion and connecting the one surface and the other surface, and the sliding surface 3211 is supported (borne) on the main frame 2 and slidable adjacent to the thrust plate 24. The second spiral body 322 forms a spiral wall protruding from one surface of the second substrate 321 and the tip of the second spiral body 322 protrudes toward the one end side U. Note that a sealing part for preventing leakage of refrigerant is provided at a tip portion of the first spiral body 312 in the fixed scroll 31 and the tip portion of the second spiral body 322 in the orbiting scroll 32. The cylindrical portion 323 is a cylindrical boss formed by protrusion from the substantially center of the other surface of the second substrate 321 toward the other end side L. An orbiting bearing that supports a slider 71 that will be described later and configured to rotate, namely a journal bearing, and is provided on the inner peripheral surface of the cylindrical portion 323 in such a manner that the central axis of the orbiting bearing is parallel to the central axis of the crankshaft 6. The second Oldham groove 324 is a long round groove formed on the other surface of the second substrate 321. A pair of the second Oldham grooves 324 is formed to face each other. A line connecting the pair of the second Oldham grooves 324 is orthogonal to a line connecting the pair of the first Oldham grooves 215.

An Oldham ring 33 is provided in the Oldham accommodating portion 214 of the main frame 2. The Oldham ring 33 includes a ring portion 331, first key portions 332, and second key portions 333. The ring portion 331 has a ring shape. A pair of the first key portions 332 is formed on the surface on the other end side L of the ring portion 331 to face each other, and is accommodated in the pair of the first Oldham grooves 215 in the main frame 2. A pair of the second key portions 333 is formed on the surface on the one end side U of the ring portion 331 to face each other, and is accommodated in the pair of the second Oldham grooves 324 in the orbiting scroll 32. When the orbiting scroll 32 revolves by rotation of the crankshaft 6, the first key portion 332 slides in the first Oldham groove 215 and the second key portion 333 slides in the second Oldham groove 324 so that the Oldham ring 33 prevents rotation of the orbiting scroll 32

The first spiral body 312 of the fixed scroll 31 and the second spiral body 322 of the orbiting scroll 32 are meshed with each other to form a compression chamber 34. As a volume of the compression chamber 34 decreases from the outside toward the inside in a radial direction, the volume of the compression chamber 34 is gradually compressed by suctioning refrigerant into the compression chamber 34 from the outer end of the spiral body and moving the refrigerant toward the center. The compression chamber 34 communicates with a discharge port 313 at the center of the fixed scroll 31. On the surface on the one end side U of the fixed scroll 31, a muffler 35 and a discharge valve 36 are provided. The muffler 35 has a discharge hole 351, and the discharge valve 36 is configured to open and close the discharge hole 351 in a predetermined manner to prevent a reversed flow of the refrigerant.

The refrigerant is composed of, for example, a halogenated hydrocarbon having a carbon-carbon double bond in its composition, a halogenated hydrocarbon not having a carbon-carbon double bond in its composition, hydrocarbon, or a mixture including any one of these hydrocarbons. The halogenated hydrocarbon having a carbon-carbon double bond is an HFC refrigerant or a Freon series low-GWP refrigerant, having no ozone depletion potential. The low-GWP refrigerant is, for example, an HFO refrigerant, and exemplified by tetrafluoropropene such as HFO1234yf, HFO1234ze, and HFO1243zf each having a chemical formula of $C_3H_2F_4$. The halogenated hydrocarbon not having a carbon-carbon double bond is exemplified by refrigerant obtained by mixing any one of R32 (difluoromethane), R41, and other refrigerant represented by $CH_2F_2$. The hydrocarbon is exemplified by propane, propylene, or other refrigerant that is natural refrigerant. The mixture is exemplified by a mixed refrigerant obtained by mixing R32, R41, or other refrigerant into HFO1234yf, HFO1234ze, HFO1243zf, or other refrigerant.

The driving mechanism unit 4 is provided on the other end side L of the main frame 2 inside the shell 1. The driving mechanism unit 4 is provided with a stator 41 and a rotor 42. The stator 41 is, for example, a stator formed by winding a winding around an iron core formed by laminating a plurality of electromagnetic steel plates with an insulating layer interposed between the iron core and the winding and is formed in a ring shape. The stator 41 is fixed to and supported on the inside of the main shell 11 by shrinkage fitting or other methods. The rotor 42 is a cylindrical rotor having a permanent magnet built inside an iron core formed by laminating a plurality of electromagnetic steel plates. The rotor 42 has a through hole that extends vertically through the center of the rotor 42, and the rotor 42 is disposed in the internal space of the stator 41.

The sub-frame 5 is a metal frame and is provided on the other end side L of the driving mechanism unit 4 inside the shell 1. The sub-frame 5 is fixed to and supported on the inner peripheral surface on the other end side L of the main shell 11 by shrinkage fitting or welding or other methods. The sub-frame 5 includes a sub-bearing 51 and an oil pump 52. The sub-bearing 51 is a ball bearing provided at the upper portion of the center of the sub-frame 5 and has a hole that extends vertically through the center of the sub-bearing 51. The oil pump 52 is provided at the lower portion of the center of the sub-frame 5 and disposed in such a manner that at least a part of the oil pump 52 is immersed in the lubricating oil stored in the oil reservoir of the shell 1.

The crankshaft 6 is a long rod-shaped part made of metal and provided inside the shell 1. The crankshaft 6 includes a main shaft portion 61, an eccentric shaft portion 62, and an oil passage 63. The main shaft portion 61 is a shaft constituting a main portion of the crankshaft 6 and is disposed in such a manner that the central axis of the main shaft portion 61 matches the central axis of the main shell 11. The rotor 42 is in contact with and fixed to the outer surface of the main shaft portion 61. The eccentric shaft portion 62 is provided on the one end side U of the main shaft portion 61 in such a manner that the central axis of the eccentric shaft portion 62 is eccentric to the central axis of the main shaft portion 61. The oil passage 63 extends vertically through the insides of the main shaft portion 61 and the eccentric shaft portion 62. In the crankshaft 6, the one end side U of the main shaft portion 61 is inserted into the main bearing portion 22 of the main frame 2, and the other end side L of the main shaft portion 61 is inserted and fixed into the sub-bearing 51 of the sub-frame 5. Hence the eccentric shaft portion 62 is disposed in the cylindrical portion 323, and the rotor 42 is disposed with a predetermined gap held between the outer peripheral surface of the rotor 42 and the inner peripheral surface of the stator 41. Further, a first balancer 64 is provided on the one end side U of the main shaft portion 61 and a second balancer 65 is provided on the other end side L of the main shaft portion 61 to cancel out unbalance caused by orbiting of the orbiting scroll 32.

The bush 7 is made of metal such as iron and is a connection part for connecting the orbiting scroll 32 and the crankshaft 6. In the present embodiment, the bush 7 is made up of two parts and includes a slider 71 and a balance weight 72. The slider 71 is a cylindrical part with a guard formed on the slider 71 and is engaged into each of the eccentric shaft portion 62 and the cylindrical portion 323. As illustrated in FIG. 2, the balance weight 72 is a donut-shaped part provided with a weight portion 721 formed in a substantially C shape as seen from the one end side U, and the balance weight 72 is provided eccentric to the center of rotation to cancel out centrifugal force of the orbiting scroll 32. The balance weight 72 is engaged with, for example, the guard of the slider 71 by shrinkage fitting or other methods.

The power supply unit 8 is a power supply part that supplies electric power to the scroll compressor and is formed on the outer peripheral surface of the main shell 11 of the shell 1. The power supply unit 8 includes a cover 81, a power supply terminal 82, and wiring 83. The cover 81 is an open-top and closed-bottom cover part. The power supply terminal 82 is made of a metal part, having one end provided inside the cover 81 and the other end provided inside the shell 1. The one end of the wiring 83 is connected to the power supply terminal 82, and the other end of the wiring 83 is connected to the stator 41.

Figure 4:
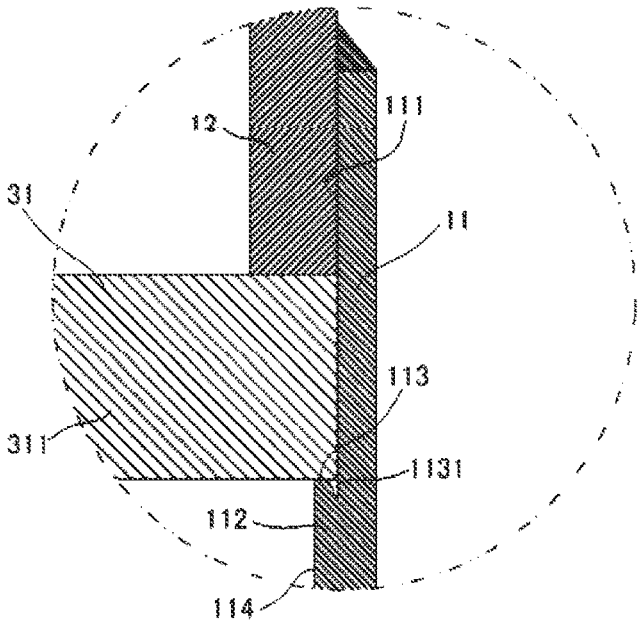
FIG. 4 is an enlarged view of a region indicated by a two-dot chain line in FIG. 3.

Next, the relationship between the shell 1 and the compression mechanism unit 3 will be more specifically described with reference to FIGS. 3 and 4. FIG. 4 is an enlarged view of a region indicated by a two-dot chain line in FIG. 3.

As illustrated in FIG. 4, the shell 1 includes a first inner wall surface 111, a first protrusion 112 that protrudes from the first inner wall surface 111 to position the fixed scroll 31, and a first positioning surface 113 of the first protrusion 112 that faces toward the upper shell 12. That is, the main shell 11 is provided with a stepped portion with its inner diameter increasing toward the other end side L. The fixed scroll 31 is positioned at the first positioning surface 113 and fixed to the first inner wall surface 111 by shrinkage fitting or other methods. This structure eliminates the need of a wall for fixing of the fixed scroll 31 with a screw for the main frame 2 as has been required in the conventional case. That is, such a structure is formed where the wall of the main frame 2 is not placed between the side surface 3212 of the second substrate 321 in the orbiting scroll 32 and the inner wall surface of the main shell 11, and the side surface 3212 of the second substrate 321 and the inner wall surface of the main shell 11 are disposed facing each other. Hence it is possible to make wider than in the conventional case a refrigerant intake space 37, in which the orbiting scroll 32 is disposed and provided between the first substrate 311 of the fixed scroll 31 and the thrust bearing of the main frame 2 in the main shell 11. Further, as the structure of the main frame 2 is simplified, its weight is reduced while the processability is improved.

The widening of the refrigerant intake space 37 can bring various advantages. For example, in a low-pressure shell structure as in the present embodiment where the pressure of the space in the main shell 11 accommodating the driving mechanism unit 4 and the pressure of the refrigerant intake space 37 are lower than the pressure of the refrigerant intake space 37, the second substrate 321 of the orbiting scroll 32 is pressed onto the thrust plate 24 by pressure of the compressed refrigerant, so that a thrust load occurs in the sliding place. Hence, a structure where the diameter of the second substrate 321 of the orbiting scroll 32 and the diameter of the thrust plate 24 are made longer to increase a sliding area while the spiral body and other parts remain in the conventional design enables reduction in thrust load. It is thus possible to enhance the reliability even in the case of using high-pressure refrigerant that increases stress on the thrust bearing due to containing R32 in a refrigeration cycle apparatus that circulates refrigerant provided with the scroll compressor of an embodiment of the present invention, a condenser, an expansion valve, and an evaporator.

Further, as illustrated in FIG. 3, the outer diameter of the upper shell 12 is made smaller than that of one end side of the main shell 11, so that the upper shell 12 and the first positioning surface 113 of the first protrusion 112 sandwich the fixed scroll 31. It is thereby possible to press the fixed scroll 31 onto the first positioning surface 113 with the upper shell 12 at the time of manufacturing and to improve the positioning accuracy of the fixed scroll 31. In addition, it is possible to prevent vertical positional shift of the fixed scroll 31 caused by vibrations or other phenomenon that can occur during transport or driving of the scroll compressor. When at least a part of the outer wall surface of the upper shell 12 is in internal contact with the inner wall surface of the main shell 11, the strength of fixing the main shell 11 and the upper shell 12 by welding or other methods can be enhanced to prevent vertical positional shift of the fixed scroll 31, and hence this state is further desired.

Note that that the main frame 2 is also positioned at a second positioning surface 116 of a second protrusion 115 that projects from a second inner wall surface 114 and fixed to the second inner wall surface 114 of the shell 1 by shrinkage fitting or other methods.

Figure 5:
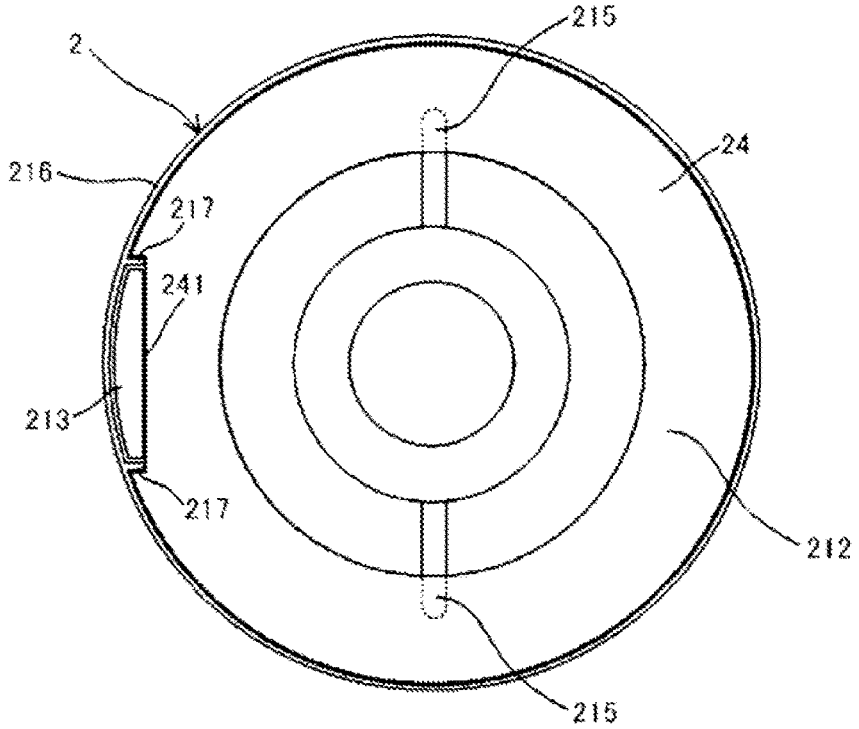
FIG. 5 is a top view of a main frame seen from above.

FIG. 5 is a top view of the main frame 2 seen from above. A ring-shaped protruding wall 216 protruding in the direction to the upper shell 12 is formed at the outer edge portion of the flat surface 212 of the main frame 2. The thrust plate 24 is disposed on the flat surface 212 inside the protruding wall 216 and covers a part of the first Oldham groove 215. As illustrated in FIG. 3, a height h of the protruding wall 216 from the flat surface 212 is set smaller than a thickness d of the thrust plate 24, so that the orbiting scroll 32 can be slid with the thrust plate 24. Note that adjusting the thickness d of the thrust plate 24 also enables a spiral tip clearance, which is an interval between the substrate of the one scroll and the spiral body of the other scroll, to be set in a preferable range. For example, the thickness d of the thrust plate 24 is normally about 0.5 mm, and when a thrust plate with a thickness d of 0.6 mm is used, the spiral tip clearance can be decreased to prevent refrigerant from passing through the clearance between the spiral tip and the substrate and leaking to an adjacent compressed space.

Here, a convex portion and a concave portion are each formed on a corresponding one of the thrust plate 24 and the protruding wall 216, and the convex portion and the concave portion are engaged with each other to prevent the rotation of the thrust plate 24. This is because, as the flat surface 212 of the main frame 2 and the thrust plate 24 both have the ring shape, the thrust plate 24 may rotate on the flat surface 212 with the orbiting of the orbiting scroll 32, and the rotation is prevented by locking the convex portion to the concave portion. In the present embodiment, the convex portion is made up of a pair of projections 217 formed protruding from the protruding wall 216 in the direction to the thrust plate 24, the concave portion is made up of a notch 241 formed in the outer peripheral portion of the thrust plate 24, and each of the pair of projections 217 is provided to be locked to a corresponding side of the notch 241. Note that a suction port 213 is disposed in a portion located between the pair of projections 217 of the main frame 2. That is, with the suction port 213 being disposed in the portion of the notch 241, refrigerant can be suctioned into the refrigerant intake space 37 without being interrupted by the thrust plate 24.

The actions of the scroll compressor will be described. When power is supplied to the power supply terminal 82 of the power supply unit 8, torque is generated in the stator 41 and the rotor 42, and with this torque, the crankshaft 6 rotates. The rotation of the crankshaft 6 is transmitted to the orbiting scroll 32 via the eccentric shaft portion 62 and the bush 7. The orbiting scroll 32, to which the rotary driving force has been transmitted, is restricted by the Oldham ring 33 in its rotation, and makes an eccentric orbital motion adjacent to the fixed scroll 31. At this time, the other surface of the orbiting scroll 32 slides on the thrust plate 24.

With the orbiting motion of the orbiting scroll 32, refrigerant suctioned from the suction pipe 14 into the shell 1 reaches the refrigerant intake space 37 through the suction port 213 of the main frame 2, and is suctioned into the compression chamber 34 formed by the fixed scroll 31 and the orbiting scroll 32. With the eccentric orbital motion of the orbiting scroll 32, the refrigerant is reduced in volume and compressed while moving in the direction from the outer peripheral portion to the center. During the eccentric orbital motion of the orbiting scroll 32, the orbiting scroll 32 moves radially together with the bush 7 by its own centrifugal force, and the side wall surfaces of the second spiral body 322 and the first spiral body 312 come into close contact with each other. The compressed refrigerant reaches the discharge hole 351 of the fixed scroll 31 through the discharge port 313 of the fixed scroll 31 and discharged to the outside of the shell 1 against the discharge valve 36.

Figure 6:
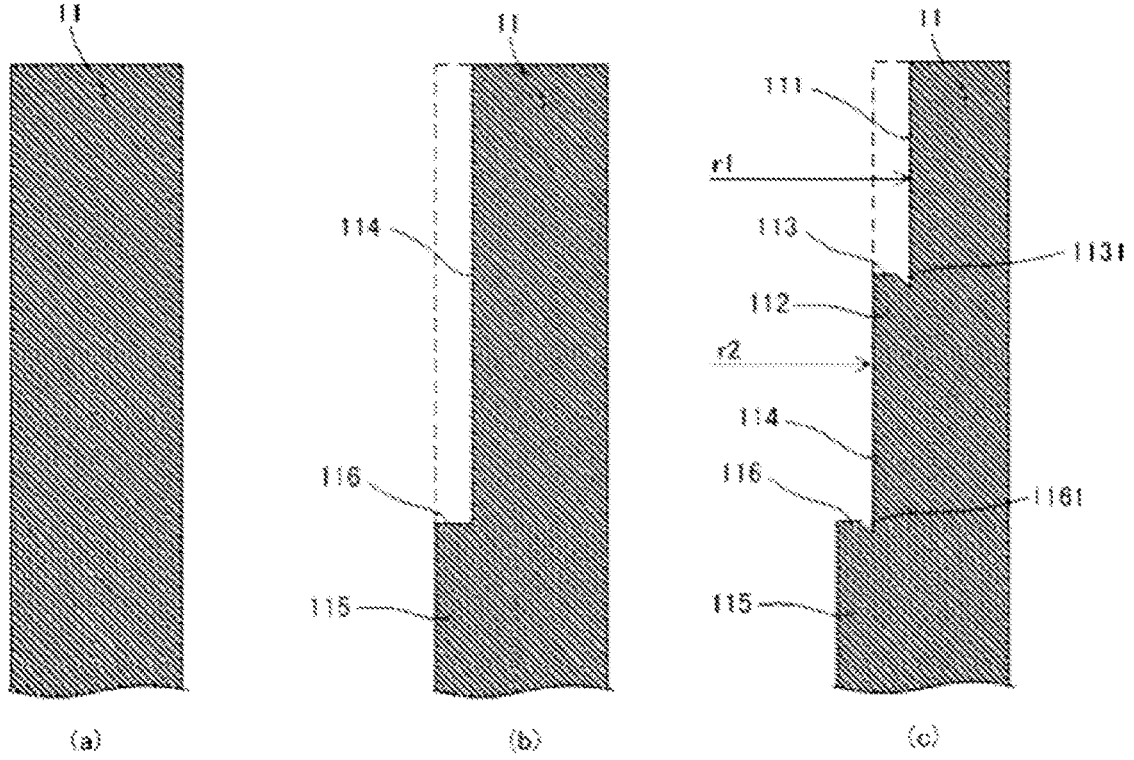
FIG. 6 is an explanatory drawing for explaining one manufacturing method for a main shell.

The manufacturing method for the scroll compressor of the present embodiment, and in particular the processing of the main shell 11 and the placement of the fixed scroll 31 and other parts will be described more specifically with reference to FIG. 6. FIG. 6 is an explanatory drawing for explaining one manufacturing method for the main shell. Note that FIG. 6 is a schematic view illustrating a cross section of one wall of the main shell 11, and its size and thickness are different from actual ones.

First, a cutting blush or other tool is inserted from the one end side U of the main shell 11 as in FIG. 6(*a*), and the inner wall surface is subjected to cutting in the thickness direction by a predetermined depth, to form a step including the second inner wall surface 114 and the second protrusion 115 as in FIG. 6(*b*). The thickness of the main shell 11 is from 4 to 6 mm, for example, and the height of the protrusion, namely the cut depth by the cutting, is about 0.3 mm, for example. Next, on the second inner wall surface 114, which is a predetermined distance apart from the second protrusion 115 in the direction to the upper shell 12, the inner wall surface is subjected to the cutting with the cutting blush or other tool in the thickness direction by a predetermined depth, to form a step including the first inner wall surface 111 and the first protrusion 112 as in FIG. 6(*c*). Thus, an inner diameter r1 of the first inner wall surface 111 is larger than an inner diameter r2 of the second inner wall surface 114. Further, the first protrusion 112 is formed closer to the upper shell 12 than is the second protrusion 115 and its inner wall surface corresponds to the second inner wall surface 114. The second protrusion 115 may be formed after the formation of the first protrusion 112.

After the cutting in FIGS. 6(*b*) and 6(*c*), a connecting portion on the first protrusion 112 with the first inner wall surface 111 (part of the first positioning surface 113 close to the first inner wall surface 111) and a connecting portion on the second protrusion 115 with the second inner wall surface 114 (part of the second positioning surface 116 close to the second inner wall surface 114) are subjected to outer-diameter cutting by using a rhomboid insert or other tool, to form recesses 1131 and 1161 each in a shape recessed in the direction to the lower shell 13. Each of the recesses 1131 and 1161 is a reduced portion formed by removing, by cutting, the curved surface that tends to be generated in the connecting portion described above. That is, when the cutting is performed, the connecting portion of the first inner wall surface 111 and the first positioning surface 113 tends to be formed in a round shape rather than at right angles. When the connecting portion is formed in the round shape, even when the fixed scroll 31 is disposed on the first protrusion 112, the fixed scroll 31 comes off the first positioning surface 113 without coming into contact with the first positioning surface 113, resulting in low positioning accuracy. In contrast, by forming the recess 1131, the fixed scroll 31 reliably comes into contact with the first positioning surface 113, so that the positioning accuracy can be enhanced. The same applies to the recess 1161, and the positioning accuracy of the main frame 2 can be enhanced. Note that forming each of the recesses 1131 and 1161 each in the shape recessed in the direction to the lower shell 13 can prevent reduction in thickness of the main shell 11 compared with the case where the recesses are formed in the shape recessed in the radial direction of the main shell, thereby preventing lowering of the strength.

Next, the main frame 2 is inserted from the one end side U of the main shell 11, having been formed as described above. The main frame 2 comes into surface contact with the second positioning surface 116 of the second protrusion 115, to be positioned in the height direction. In this state, the main frame 2 is fixed to the second inner wall surface 114 by shrinkage fitting, arc spot welding, or other methods. Then, after insertion of the crankshaft 6 into the shaft hole 221 of the main frame 2, the bush 7 is attached to the eccentric shaft portion 62, and further, the Oldham ring 33, the orbiting scroll 32, and other parts are disposed.

Subsequently, the fixed scroll 31 is inserted from the one end side U of the main shell 11. The fixed scroll 31 comes into surface contact with the first positioning surface 113 of the first protrusion 112, to be positioned in the height direction. In the present embodiment, without a part for circumferentially positioning the fixed scroll 31 like the conventional screw, the fixed scroll 31 is rotatable adjacent to the orbiting scroll 32 until the fixed scroll 31 is fixed to the first inner wall surface 111, and hence the positional relationship between the first spiral body 312 and the second spiral body 322 may be shifted to cause compression variations or compression failure for each product of the scroll compressor. The fixed scroll 31 is therefore rotated to set predetermined positional relationship of the first spiral body 312 with the second spiral body 322 in the orbiting scroll 32 to adjust phases, and subsequently, the fixed scroll 31 is fixed to the first inner wall surface 111 by shrinkage fitting, arc spot welding, or other methods.

Finally, after insertion of the upper shell 12 from the one end side U of the main shell 11, the main shell 11 and the upper shell 12 are fixed by welding, arc spot welding, or other methods. At this time, the upper shell 12 is inserted to press the fixed scroll 31 onto the first positioning surface 113, and the fixed scroll 31 is fixed to the main shell 11 while such a state is maintained so that variations in height of the refrigerant intake space 37 for each scroll compressor are reduced to enhance the positional accuracy and prevent vertical shift of the fixed scroll 31 at the time of driving the scroll compressor. However, as the first protrusion 112 is only required to position at least the fixed scroll 31 in manufacturing, after fixing of the fixed scroll 31 to the first inner wall surface 111, the fixed scroll 31 is not essentially in contact with the first positioning surface 113. The same applies to the relationship between the main frame 2 and the second protrusion 115.

By the manufacturing method as above, it is possible to expand the refrigerant intake space 37 while ensuring the positional accuracy in the main frame 2, the fixed scroll 31, and the orbiting scroll 32, equivalently to the method for connecting the main frame 2 and the fixed scroll 31 with a screw or others as in the conventional case. In addition, as no screws or others are used, the manufacturing can be made easier.

In the present embodiment, the scroll compressor includes the main frame 2 holding the orbiting scroll 32 configured to slide, the fixed scroll 31 configured to form the compression chamber 34 together with the orbiting scroll 32, and the shell 1 accommodating the fixed scroll 31, the shell 1 includes the first inner wall surface 111 and the first protrusion 112 protruding from the first inner wall surface 111 to position the fixed scroll 31, and the fixed scroll 31 is fixed to the first inner wall surface 111, thereby forming the structure where the side surface 3212 located in the radially outermost portion of the orbiting scroll 32 and the inner wall surface of the shell 1 face each other, and the main frame 2 is not placed between the side surface 3212 of the second substrate 321 and the inner wall surface of the main shell 11. Hence the fixed scroll 31 can be disposed in the shell 1 while no peripheral wall for fixing the fixed scroll 31 is formed on the main frame 2, to expand the refrigerant intake space 37 where the orbiting scroll 32 is disposed. In addition, for example, by increasing the diameters of the second substrate 321 of the orbiting scroll 32 and the thrust plate 24, it is possible to increase a sliding area and reduce the surface pressure caused by a thrust load. As the wall for fixing the fixed scroll 31 to the main frame 2 is unnecessary, it is possible to reduce the weight of the main frame 2 while shortening the processing time for the main frame 2.

The shell 1 also includes the second inner wall surface 114 and the second protrusion 115 that protrudes from the second inner wall surface 114 and is positioned in the main frame 2, and the main frame 2 is fixed to the second inner wall surface 114. It is thus possible to fix the fixed scroll 31 and the main frame 2 to the shell 1 by the same method in a series of manufacturing processes, and thereby to facilitate manufacturing.

The second inner wall surface 114 is formed on the inner wall surface of the first protrusion 112. That is, the inner wall surface of the first protrusion 112 corresponds to the second inner wall surface 114. This configuration enables formation of the first protrusion 112 and the second protrusion 115 by a small number of steps. Further, the inner diameter r1 of the first inner wall surface 111 is formed to be larger than the inner diameter r2 of the second inner wall surface 114, the shell 1 includes the main shell 11 with both ends opened, the upper shell 12 that covers the opening port on one end side of the main shell 11, and the lower shell 13 that covers the opening port on the other end side of the main shell 11, the first positioning surface 113 for positioning the fixed scroll 31 is formed at a part of the first protrusion 112 that is close to the upper shell 12, and the second positioning surface 116 for positioning the main frame 2 is formed at a part of the second protrusion 115 that is close to the upper shell 12. It is thus possible to fix the fixed scroll 31 and the main frame 2 to the main shell 11 by the same method, and thereby to facilitate assembly.

Further, the first positioning surface 113 is formed closer to the upper shell 12 than is the sliding surface 3211 of the orbiting scroll 32 that slides adjacent to the main frame 2, and the second positioning surface 116 is formed closer to the lower shell 13 than is the sliding surface 3211. Thus, after the main frame 2 is inserted from the one end side U and fixed to the main shell 11, the orbiting scroll 32 and the fixed scroll 31 can be sequentially inserted and fixed while the main shell 11 is kept in that posture, so that it is possible to facilitate assembly.

In the connecting portion on the first protrusion 112 with the first inner wall surface 111 and the connecting portion on the second protrusion 115 with the second inner wall surface 114, the recesses 1131 and 1161 are formed in the direction to the lower shell. The contact between the first positioning surface 113 and the fixed scroll 31 and the contact between the second positioning surface 116 and the main frame 2 can thus be satisfactorily maintained, and enhance the positioning accuracy.

The outer diameter of the upper shell 12 is smaller than the inner diameter of the one end side of the main shell 11, and the upper shell 12 and the first protrusion 112 sandwich the fixed scroll 31. Hence the fixed scroll 31 can be pressed to the first positioning surface 113 to reliably come into contact with the first positioning surface 113. Further, it is possible to prevent vertical movement of the fixed scroll 31 away from and toward the main shell 11.

The main frame 2 has the thrust plate 24 located on the flat surface 212 facing the orbiting scroll 32 and configured to slide adjacent to the sliding surface 3211, the protruding wall 216 protruding in the direction to the upper shell 12 is formed at an outer end portion of the flat surface 212 of the main frame 2, and the height h of the protruding wall 216 from the flat surface 212 is smaller than the thickness d of the thrust plate 24. The thrust plate 24 can thus be slid without the orbiting scroll 32 interfering with the main frame 2.

Further, the convex portion and the concave portion are each formed on a corresponding one of the thrust plate 24 and the protruding wall 216, and the convex portion and the concave portion are engaged with each other to prevent the rotation of the thrust plate. The convex portion is made up of the pair of projections 217 formed protruding from the protruding wall 216 in the direction to the thrust plate 24, the concave portion is made up of a notch 241 formed in the outer peripheral portion of the thrust plate, and the pair of projections 217 is provided in the notch 241. It is thus possible to prevent rotation of the thrust plate 24 adjacent to the flat surface 212 of the main frame 2. Further, between the pair of projections 217 of the frame, the suction port 213 is formed penetrating in the direction to the upper shell 12 and the direction to the lower shell 13. It is thus possible to prevent the suction port 213 from being blocked by the thrust plate 24 and to stably supply refrigerant to the refrigerant intake space 37.

In the refrigeration cycle apparatus that includes the scroll compressor, a condenser, an expansion valve, and an evaporator, and circulates refrigerant, high-pressure refrigerant containing, for example, R32 may be used for the refrigerant. When the high-pressure refrigerant containing R32 or other refrigerant is used, stress on the thrust bearing increases, but in the present embodiment, it is possible to increase the diameters of the second substrate 321 of the orbiting scroll 32 and the thrust plate 24 and to increase the sliding area, thereby reducing the stress on the thrust bearing and enhancing the reliability.

Embodiment 2

Figure 7:
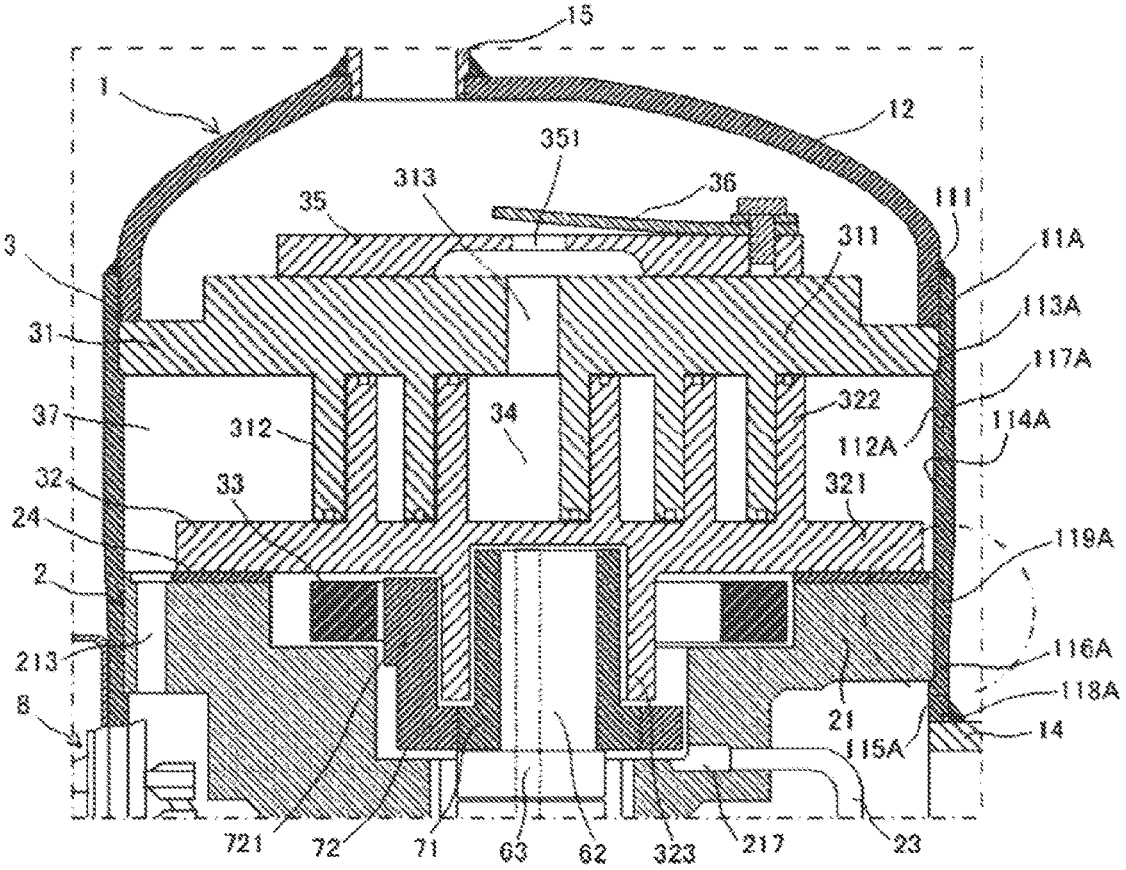
FIG. 7 is a sectional view of a scroll compressor according to Embodiment 2 of the present invention.
Figure 8:
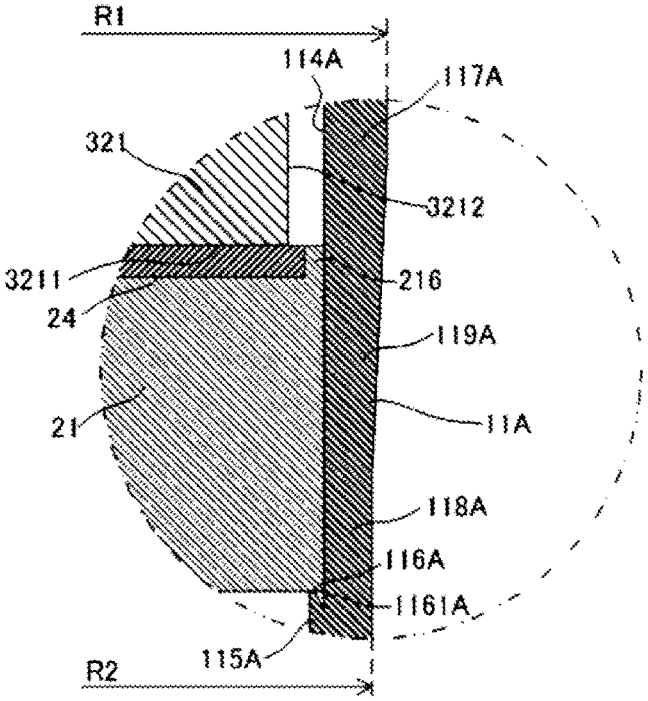
FIG. 8 is an enlarged view of a region indicated by a two-dot chain line in FIG. 7.

FIG. 7 is a sectional view of a scroll compressor according to Embodiment 2 of the present invention, and FIG. 8 is an enlarged view of a region indicated by a two-dot chain line in FIG. 7. In the following embodiments and others, a portion having the same configuration as that in the scroll compressor of FIGS. 1 to 6 will be provided with the same reference sign and its description will be omitted.

In Embodiment 2, a main shell 11A has a stepped shape, provided with a first straight pipe portion 117A, a second straight pipe portion 118A, and a coupling portion 119A. The first straight pipe portion 117A is provided on the one end side U of the main shell 11A. The second straight pipe portion 118A has an outer diameter R2 smaller than an outer diameter R1 of the first straight pipe portion 117A and is provided closer to the other end side L than is the first straight pipe portion 117A. The outer wall surface of the coupling portion 119A changes with its diameter increasing from the second straight pipe portion 118A toward the first straight pipe portion 117A, and the coupling portion 119A connects the first straight pipe portion 117A and the second straight pipe portion 118A.

As seen from FIG. 8, at least a part of a second inner wall surface 114A is formed on the inner wall surface of the coupling portion 119A. That is, the outer wall surface of the coupling portion 119A has the shape with the changing outer diameter, but the inner wall of the coupling portion 119A has the flat surface along the central axis of the crankshaft 6. In particular, the second inner wall surface 114A is formed to extend over the inner walls of the first straight pipe portion 117A, the second straight pipe portion 118A, and the coupling portion 119A and is formed as one plane. A second protrusion 115A protrudes from the second inner wall surface 114A closer to the other end side L than is the coupling portion 119A, a second positioning surface 116A is formed on the one end side U of the second protrusion 115A, and the main shell 11A is positioned at the second protrusion 115A and fixed at the second inner wall surface 114A. In addition, a first inner wall surface 111A is formed on the inner wall surface of the first straight pipe portion 117A.

Figure 9:
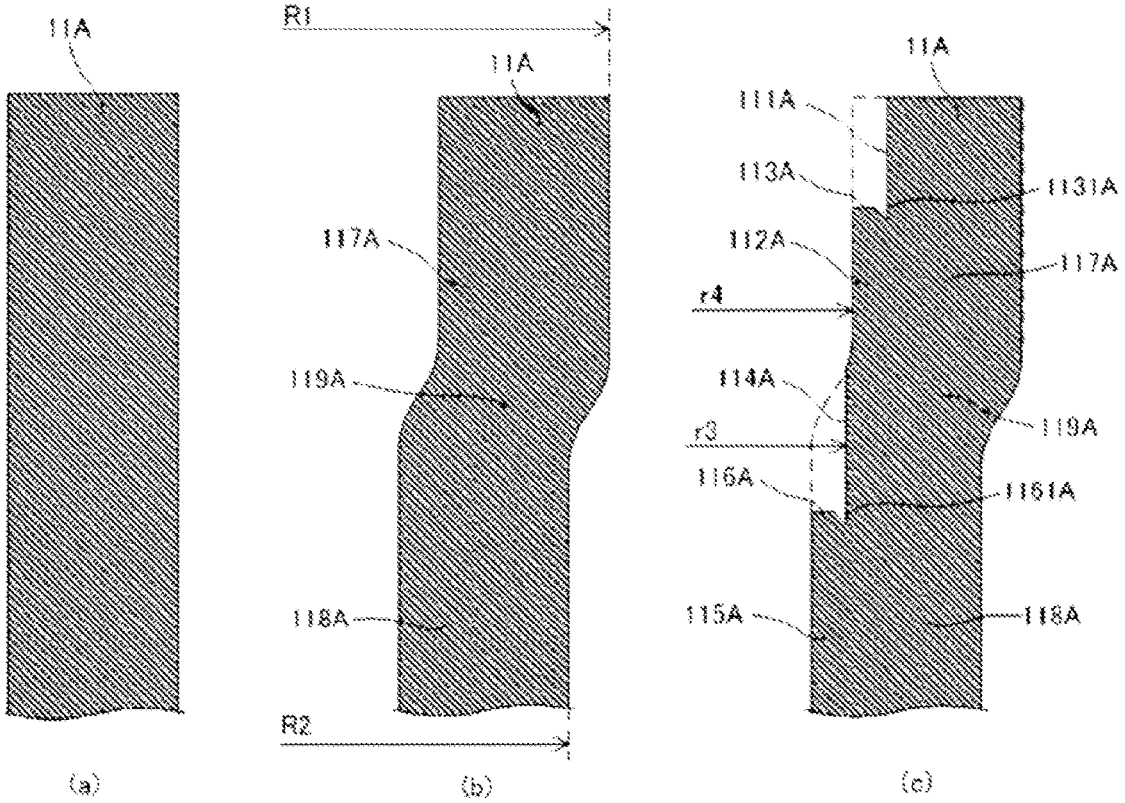
FIG. 9 is an explanatory drawing for explaining one manufacturing method for a main shell according to Embodiment 2 of the present invention.

The processing method for the main shell 11A of the scroll compressor of the present embodiment will be described more specifically with reference to FIG. 9. FIG. 9 is an explanatory drawing for explaining one manufacturing method for the main shell according to Embodiment 2 of the present invention. Note that FIG. 9 is a schematic view illustrating a cross section of one wall of the main shell 11, and its size and thickness are different from actual ones.

First, a press machine is inserted from the one end side U of the main shell 11A formed in a cylindrical shape as in FIG. 9(*a*), and the main shell 11A is subjected to press working or other processing, to be formed into the stepped shape including the first straight pipe portion 117A, the second straight pipe portion 118A, and the coupling portion 119A as in FIG. 9(*b*). Next, a cutting blush or other tool is inserted from the one end side U of the main shell 11A, and a part of the inner wall surfaces of the coupling portion 119A and the second straight pipe portion 118A is subjected to cutting in the thickness direction to form a step including the second inner wall surface 114A and the second protrusion 115A. Here, the first straight pipe portion 117A is not cut so that an inner diameter r3 of the coupling portion 119A and the second straight pipe portion 118A after the cutting is made smaller than an inner diameter r4 of the first straight pipe portion 117A. Next, from the one end side U of the main shell 11A, the inner wall surface of the first straight pipe portion 117A is subjected to cutting in the thickness direction by a predetermined depth by using the cutting blush or other tool, to form a step including the first inner wall surface 111A and the first protrusion 112A. Then, in the same manner as in Embodiment 1, after formation of recesses 1131A and 1161A, and other portions, the main frame 2, the fixed scroll 31, and other parts are disposed sequentially. In this manufacturing method, the cutting for forming two steps on the inner wall surface can be performed independently in the first straight pipe portion 117A, the second straight pipe portion 118A, and the coupling portion 119A, so that the cutting amount of the main shell 11A is only within a range indicated by a dotted line in FIG. 6(*c*), and the time required for the cutting can thus be shortened. Moreover, the thickness of the first straight pipe portion 117A in the first inner wall surface 111A and the thickness of the second straight pipe portion 118A in the second inner wall surface 114A can be made about the same, thus preventing the thickness of the main shell 11A from being locally reduced due to the cutting.

At the time of forming the second inner wall surface 114A, the cutting may be performed to make the inner diameter r3 of the inner wall surface in the cutting section almost the same as the inner diameter r4 of the inner wall surface of the first straight pipe portion 117A. That is, each of the inner wall surfaces of the first straight pipe portion 117A, the second straight pipe portion 118A, and the coupling portion 119A may be made flush with each other to form the second inner wall surface 114A. By making these surfaces flush with each other, no step is formed, and hence the main frame 2 can be smoothly inserted from the one end side U of the main shell 11A. When it is difficult in terms of a manufacturing error to make the inner diameters of the inner wall surfaces of the coupling portion 119A and the second straight pipe portion 118A almost the same as the inner diameter r4 of the inner wall surface of the first straight pipe portion 117A, the inner wall surfaces may be made flush with each other by slightly cutting the inner wall surface of the first straight pipe portion 117A as well at the time of cutting the inner wall surfaces of the coupling portion 119A and the second straight pipe portion 118A.

In the present embodiment, the main shell 11A includes the first straight pipe portion 117A, the second straight pipe portion 118A having the outer diameter R2 that is smaller than the outer diameter R1 of the first straight pipe portion 117A, and the coupling portion 119A that couples the first straight pipe portion 117A and the second straight pipe portion 118A, and at least a part of the second inner wall surface 114A is formed on the inner wall of the coupling portion 119A. It is therefore possible to form the whole or a part of the second protrusion 115A by cutting the inner wall surface of the coupling portion 119A, thereby reducing a cutting amount as compared to that in the case of the main shell 11A, which is typical cylindrical, and facilitating manufacturing.

Further, the first inner wall surface 111A is formed on the inner wall of the first straight pipe portion 117A, and the second inner wall surface 114A is formed on the inner walls of the second straight pipe portion 118A and the coupling portion 119A. Hence the first protrusion 112A can be formed by cutting a part of the inner wall surface of the first straight pipe portion 117A and the second protrusion 115A can be formed by cutting a part of the inner wall surfaces of the coupling portion 119A and the second straight pipe portion 118A. The depths of the cutting for forming the first protrusion 112A and the second protrusion 115A can therefore be made about the same, to prevent the first straight pipe portion 117A subjected to the cutting from being excessively reduced in thickness. Further, the second inner wall surface 114A becomes sufficiently long, to enhance the fixing strength with the main frame 2. The stepped shape is formed as the inner diameter r3 of the second inner wall surface 114A is smaller than the inner diameter r4 of the first straight pipe portion 117A, but the step is insignificant, and because the inner wall surface of the coupling portion 119A has a tapered shape, at the time of inserting the main frame 2 into the main shell 11A from the one end side U, the smooth insertion is not prevented by the step. It is thus possible to easily perform manufacturing while reducing the amount of cutting for forming the second inner wall surface 114A.

Embodiment 3

Figure 10:
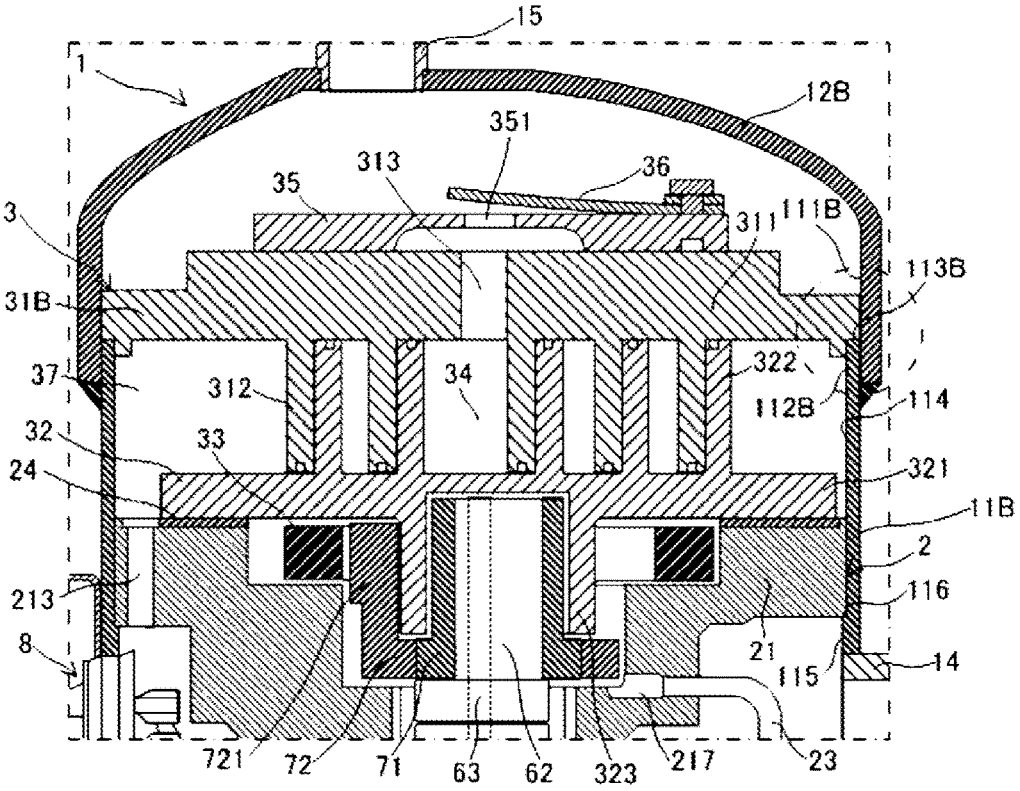
FIG. 10 is a sectional view of a scroll compressor according to Embodiment 3 of the present invention.
Figure 11:
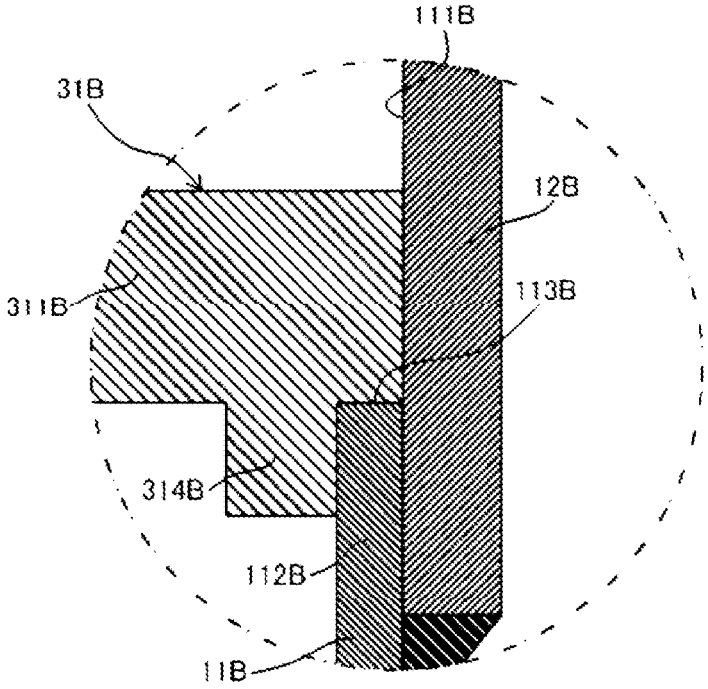
FIG. 11 is an enlarged view of a region indicated by a two-dot chain line in FIG. 10.

FIG. 10 is a sectional view of a scroll compressor according to Embodiment 3 of the present invention, and FIG. 11 is an enlarged view of a region indicated by a two-dot chain line in FIG. 10.

In Embodiment 3, an inner diameter of an upper shell 12B is set to be larger than an outer diameter of one end side of a main shell 11B, and a fixed scroll 31B is positioned at the one end side U of the main shell 11B and fixed to the inner wall surface of the upper shell 12B. That is, a step is formed by the main shell 11B and the upper shell 12B, the inner wall surface of the upper shell 12B corresponds to a first inner wall surface 111B, the one end side U of the main shell 11B corresponds to a first protrusion 112B, and the end face of the one end side U of the main shell 11B corresponds to a first positioning surface 113B. This configuration eliminate the need for performing the cutting or other processing on the inner wall surface of the main shell 11B to form the first protrusion 112B, and can thus facilitate manufacturing. Note that the fixed scroll 31B can be fixed by being screwed to the upper shell 12B, by being spot-welded with the upper shell 12B with a laser or other device, by being screwed to the end face on the one end side U o f the main shell 11B, or by other methods. As the main shell 11B and the upper shell 12B are welded to each other, the upper shell 12B is desirably provided in such a manner that at least a part of the upper shell 12B is in internal contact with the main shell 11B.

Further, as illustrated in FIG. 11, a protruding wall 314B protruding toward the other end side L is formed on the outer edge portion of a first substrate 311B of the fixed scroll 31B. The protruding wall 314B is a protruding piece for radially positioning the fixed scroll 31B to the main shell 11B, and the protruding wall 314B is disposed in such a manner that its outer wall surface is in contact with the inner wall surface of the main shell 11B and fixed by shrinkage fitting. As a result, when the fixed scroll 31B is disposed on the first positioning surface 113B, the fixed scroll 31B can be prevented from being radially shifted from the main shell 11B.

In the present embodiment, the inner diameter of an upper shell 12B is set to be larger than the outer diameter of one end side of a main shell 11B, and the first positioning surface 113B is formed at the end portion of the main shell 11B that is close to the upper shell 12B, so that there is no need for performing the cutting or other processing on the inner wall surface of the main shell 11B to form the first protrusion 112B, and it is possible to facilitate manufacturing.

Embodiment 4

Figure 12:
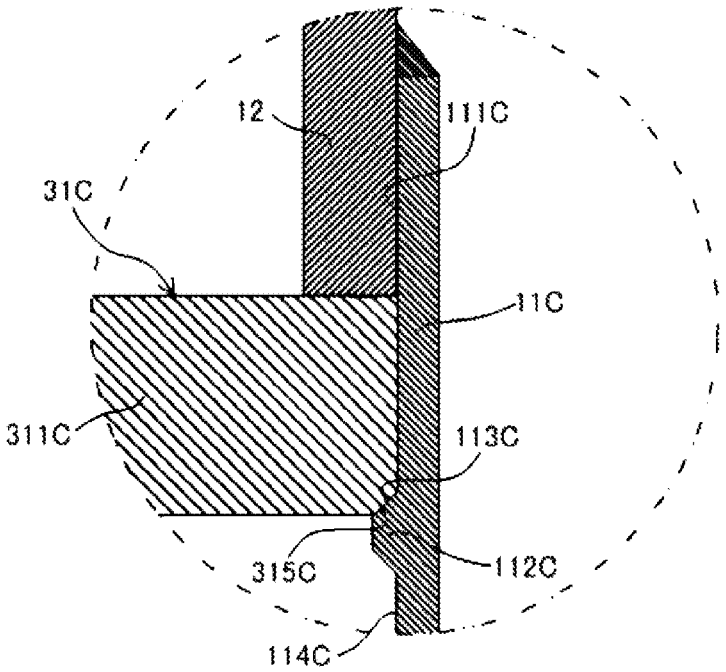
FIG. 12 is a sectional view of a scroll compressor according to Embodiment 4 of the present invention.

FIG. 12 is a sectional view of a scroll compressor according to Embodiment 4 of the present invention.

In Embodiment 4, a first protrusion 112C is formed into a protruding shape that protrudes from a first inner wall surface 111C, and a fixed scroll 31C is positioned on the first protrusion 112C. A first protrusion 112C can thus be formed easily. The first protrusion 112C can be formed by cutting on the first inner wall surface 111C, and can also be formed by making a previously formed part in a protruding shape adhere to the inner wall surface, or by other methods. Further, a first positioning surface 113C is formed in a tapered shape on the first protrusion 112C, an inclined surface 315C is also formed on a first substrate 311C of the fixed scroll 31C, and the inclined surfaces are brought into contact with each other. It is thus possible to enhance the positioning accuracy of the fixed scroll 31C to the main shell 11C.

Note that the present invention is not limited to the invention relating to the above embodiments, but can be modified as appropriate in the scope not deviating from its gist.

For example, the vertical scroll compressor has been described in the above embodiments, but the present invention is also applicable to a horizontal scroll compressor. At this time, also in the horizontal scroll compressor, it is possible to define the side on which the compression mechanism unit is provided as one end side and the side on which the driving mechanism unit is provided as the other end side across the main frame. Further, the present invention is not limited to the scroll compressor of the low-pressure shell system, but is also applicable to a scroll compressor of a high-pressure shell system, in which pressure of the space in the main shell accommodating the driving mechanism unit is higher than pressure of the refrigerant intake space. In the high-pressure shell system, as a load in the thrust bearing is small, it is desirable to adopt a structure to increase a displacement as in FIG. 13 described later, or a structure to reduce the size of the compressor as in FIG. 14.

The main shell 11 is not limited to the cylindrical shape, but may have a polygonal cylindrical shape or other shape. Further, in the above embodiments, by the effect capable of expanding the refrigerant intake space 37 between the first substrate 311 of the fixed scroll 31 and the thrust bearing of the main frame 2 in the main shell 11 more than that in the conventional case, the configuration has been described where the sliding area is increased and the thrust load is reduced by increasing the diameters of the second substrate 321 of the orbiting scroll 32 and the thrust plate 24 while the spiral body and other parts are the same as those in the conventional design, but the present invention is not limited to this configuration.

Figure 13:
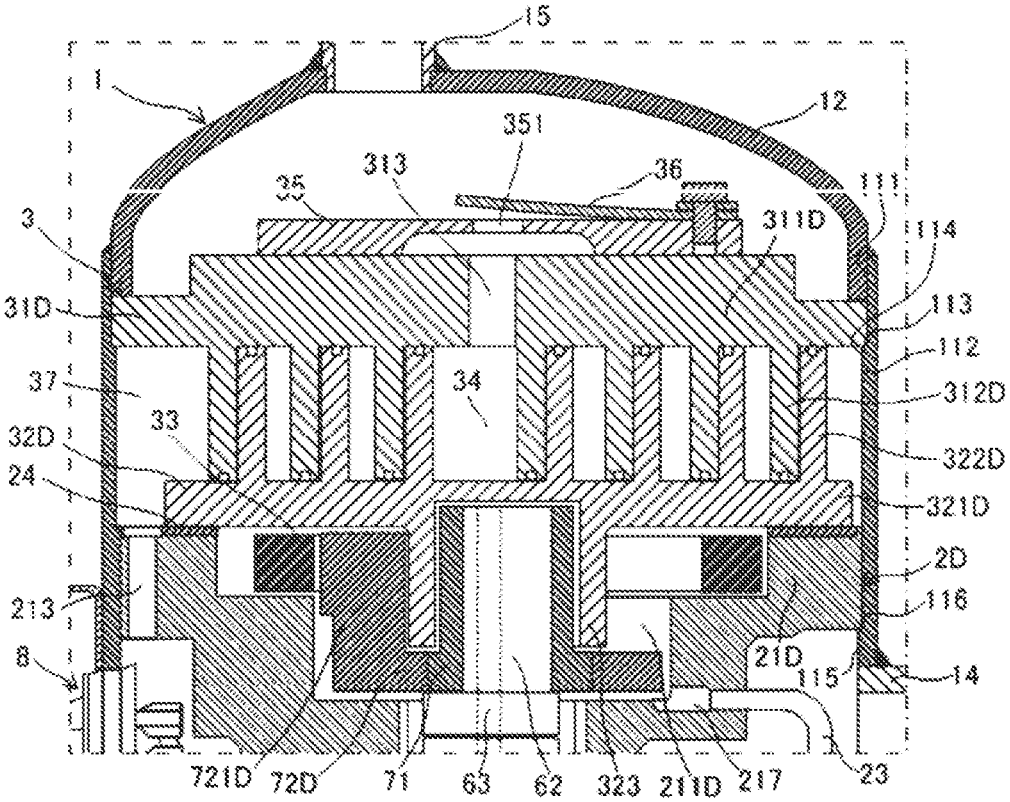
FIG. 13 is a sectional view of a scroll compressor according to Modification 1 of the present invention.

For example, as in FIG. 13, while this example is the same as Embodiment 1 that a diameter of a second substrate 321D of an orbiting scroll 32D is increased, a first spiral body 312D of a fixed scroll 31D may be formed up to the vicinity of the end portion of a first substrate 311D, and a second spiral body 322D of the orbiting scroll 32D may be formed up to the vicinity of the end portion of the second substrate 321D. As a result, the maximum intake amount of refrigerant by the scroll, namely a displacement, can be increased, thereby increasing a compression ratio and enhancing performance of the scroll compressor. Note that an HFO refrigerant, which is a low-GWP refrigerant, especially HFO1234yf, is refrigerant with a low density, and it is thus desirable to make its displacement large. By combining use of such a refrigerant with the configuration of FIG. 13, it is therefore possible achieve a scroll compressor having high performance and prevent the size of the scroll compressor from increasing.

When the second spiral body 322D and the second substrate 321D of the orbiting scroll 32D are made larger, the centrifugal force by the orbiting motion of the orbiting scroll 32D increases due to an increase in weight or other factors. Hence a volume or a weight of a weight portion 721D of a balance weight 72D needs to be increased to cancel out the centrifugal force. In contrast, in the present invention, the wall for screwing is eliminated in the main frame 2 to enhance the designing flexibility of a main frame 2D, so that it is possible to ensure a large accommodating space 211D of a main body 21D in the main frame 2D. By making the accommodating space 211D large, the balance weight 72D having the weight portion 721D with a large volume can be used, so that it is possible to cancel out the centrifugal force of the orbiting scroll 32D, having increased due to a weight increase or other factors, and reduce a radial load acting on the second spiral body 322 of the orbiting scroll 32. Hence it is possible to improve the reliability of the orbiting scroll 32 and reduce a sliding loss between the second spiral body 322 of the orbiting scroll 32 and the first spiral body 312 of the fixed scroll 31.

Figure 14:
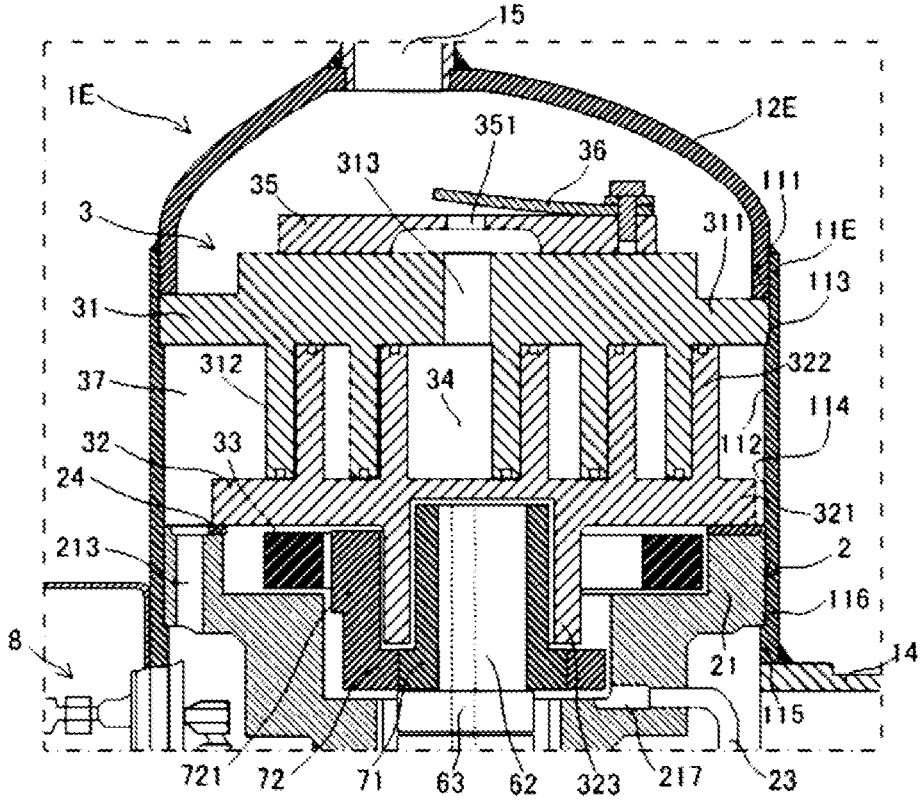
FIG. 14 is a sectional view of a scroll compressor according to Modification 2 of the present invention.

Further, as in FIG. 14, as for a shell 1E, namely a main shell 11E, an upper shell 12E, and other shells, a shell having a smaller inner diameter than that of the conventional shell may be used while the size of the orbiting scroll 32 is kept the same. It is thereby possible to achieve a small-sized scroll compressor while a displacement is equivalent to that of the conventional scroll compressor.

Various shapes and manufacturing methods can be adopted to the first protrusion 112 and the first positioning surface 113 so long as the fixed scroll 31 can be positioned with accuracy. For example, the first protrusion 112 is only required to position the fixed scroll 31, and may thus be made up of protrusions in at least two or more positions formed on the inner wall surface of the main shell 11. Alternatively, the first protrusion 112 may be formed by striking the main shell 11 from the outside. The rotation of the fixed scroll 31 adjacent to the main shell 11 may be prevented by forming a convex portion on the first positioning surface 113 and engaging the convex portion with a concave portion formed in the fixed scroll 31.

Figure 15:
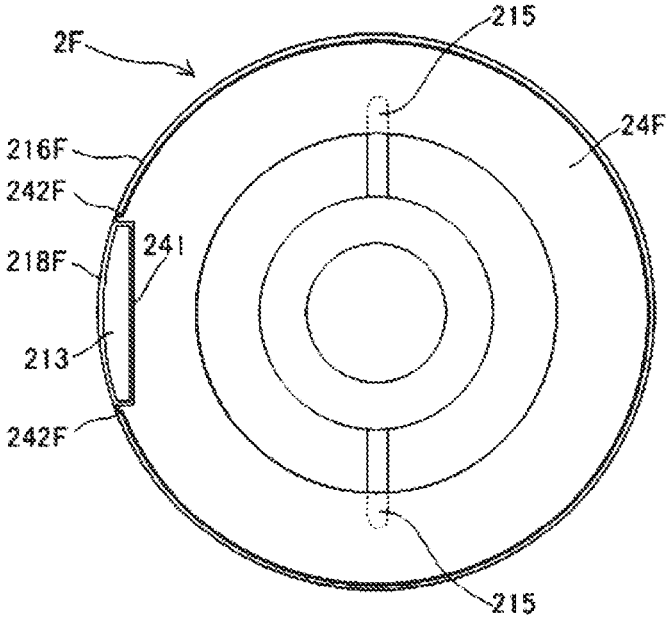
FIG. 15 is a sectional view of a scroll compressor according to Modification 3 of the present invention.

As in FIG. 15, with regard to a convex portion and a concave portion each formed on a corresponding one of a thrust plate 24F and a protruding wall 216F, such a configuration may be used where a pair of projections 242F are formed on the thrust plate 24F and protrude in the direction to a protruding wall 216F, a notch 218F is formed on the protruding wall 216F, and the pair of projections 242F is disposed in the notch 218F. It is thus possible to prevent the rotation of the thrust plate 24F as in Embodiment 1.

The thrust plate 24 is not limited to an annular shape, but may have a C-shape, and the suction port 213 having a large opening area may be disposed in a portion at the end of the C-shape of the thrust plate 24. This configuration can increase the area of the suction port 213. At this time, when the area of the suction port 213 is increased, a part of the suction port 213 may be blocked by the orbiting scroll 32, depending on the orbiting timing of the orbiting scroll 32. In this case, at the timing for suctioning the refrigerant with the fixed scroll 31 and the orbiting scroll 32, by setting the positional relationship where the suction port 213 is not blocked by the orbiting scroll 32, an influence of the blocking of the suction port 213 can be made small.

The thrust plate 24 is not essential, but it may be configured in such a manner that the flat surface 212 of the main frame 2 slides adjacent to the orbiting scroll 32.

On the inner wall surface of the main shell 11, a convex portion (or a concave portion) may be formed in a direction along the central axis of the crankshaft 6, and a concave portion (or a convex portion) to be engaged with the convex portion (or the concave portion) may be formed in the main frame 2 and the fixed scroll 31. As a result, it is possible match the phase of the first spiral body 312 of the fixed scroll 31 and the phase of the second spiral body 322 of the orbiting scroll 32, and thereby to omit the step of rotating the fixed scroll 31 adjacent to the orbiting scroll 32 to adjust the phase.

The invention claimed is:

1. A shell accommodating a frame holding an orbiting scroll configured to slide, and a fixed scroll configured to form a compression chamber together with the orbiting scroll, the shell comprising:

a first inner wall surface to which the fixed scroll is fixed;

a first protrusion protruding from the first inner wall surface to position the fixed scroll;

a second inner wall surface to which the frame is fixed; and a second protrusion protruding from the second inner wall surface to position the frame, wherein the first inner wall surface is formed to have an inner diameter that is larger than an inner diameter of the second inner wall surface.

2. A scroll compressor, comprising:

a frame holding an orbiting scroll configured to slide;

a fixed scroll configured to form a compression chamber together with the orbiting scroll; and a shell accommodating the frame and the fixed scroll, the shell including a first inner wall surface, a first protrusion protruding from the first inner wall surface to position the fixed scroll, a second inner wall surface, and a second protrusion protruding from the second inner wall surface to position the frame, the fixed scroll being fixed to the first inner wall surface, and the frame being fixed to the second inner wall surface, wherein the first inner wall surface is formed to have an inner diameter that is larger than an inner diameter of the second inner wall surface.

3. The scroll compressor of claim 2, wherein the orbiting scroll has a side surface located in a radially outermost portion of the orbiting scroll, and the side surface of the orbiting scroll and an inner wall surface of the shell face each other.

4. The scroll compressor of claim 2, wherein the second inner wall surface is formed on an inner wall surface of the first protrusion.

5. The scroll compressor of claim 2, wherein the shell includes a main shell with both ends opened, a first shell covering an opening port on one end side of the main shell, and a second shell covering an opening port on another end side of the main shell, a first positioning surface for positioning the fixed scroll is formed at a part of the first protrusion that is close to the first shell, and a second positioning surface for positioning the frame is formed at a part of the second protrusion that is close to the first shell.

6. The scroll compressor of claim 5, wherein the first positioning surface is formed closer to the first shell than is a sliding surface of the orbiting scroll configured to slide adjacent to the frame, and the second positioning surface is formed closer to the second shell than is the sliding surface.

7. The scroll compressor of claim 6, wherein the frame has a thrust plate located on a flat surface of the frame facing the orbiting scroll, the thrust plate being configured to slide adjacent to the sliding surface, a protruding wall protruding in a direction to the first shell is formed at an outer end portion of the flat surface of the frame, and a height h of the protruding wall from the flat surface is smaller than a thickness d of the thrust plate.

8. The scroll compressor of claim 7, wherein a convex portion and a concave portion are each formed on a corresponding one of the thrust plate and the protruding wall, and the convex portion and the concave portion are engaged with each other to prevent rotation of the thrust plate.

9. The scroll compressor of claim 8, wherein the convex portion comprises a pair of projections and the concave portion comprises a notch, and the pair of projections is provided in the notch.

10. The scroll compressor of claim 9, wherein a suction port is formed through the frame in a portion between the pair of projections.

11. The scroll compressor of claim 5, wherein the main shell includes a first straight pipe portion, a second straight pipe portion having an outer diameter that is smaller than an outer diameter of the first straight pipe portion, and a coupling portion coupling the first straight pipe portion and the second straight pipe portion, and at least a part of the second inner wall surface is formed on an inner wall of the coupling portion.

12. The scroll compressor of claim 11, wherein the first inner wall surface is formed on an inner wall of the first straight pipe portion, and the second inner wall surface is formed on an inner wall of at least a part of the second straight pipe portion or the inner wall of the coupling portion.

13. The scroll compressor of claim 11, wherein the second inner wall surface is formed to have an inner diameter that is smaller than an inner diameter of the first straight pipe portion.

14. The scroll compressor of claim 5, wherein the first shell is formed to have an outer diameter that is smaller than an inner diameter of the one end side of the main shell, and the first shell and the first protrusion sandwich the fixed scroll.

15. The scroll compressor of claim 5, wherein the first shell is formed to have an inner diameter that is larger than an outer diameter of the one end side of the main shell, and the first positioning surface is formed at an end portion of the main shell that is close to the first shell.

16. A refrigeration cycle apparatus, comprising:

the scroll compressor of claim 1;

a condenser;

an expansion valve; and an evaporator, the refrigeration cycle apparatus being configured to circulate refrigerant, the refrigerant containing R32.

17. A refrigeration cycle apparatus, comprising:

the scroll compressor of claim 1;

a condenser;

an expansion valve; and an evaporator, the refrigeration cycle apparatus being configured to circulate refrigerant, the refrigerant containing an HFO refrigerant.

18. A scroll compressor, comprising:

a frame holding an orbiting scroll configured to slide;

a fixed scroll configured to form a compression chamber together with the orbiting scroll; and a shell accommodating the frame and the fixed scroll, the shell including a first inner wall surface, a first protrusion protruding from the first inner wall surface to position the fixed scroll, a second inner wall surface, and a second protrusion protruding from the second inner wall surface to position the frame, the fixed scroll being fixed to the first inner wall surface, and the frame being fixed to the second inner wall surface, the shell includes a main shell with both ends opened, a first shell covering an opening port on one end side of the main shell, and a second shell covering an opening port on another end side of the main shell, a first positioning surface for positioning the fixed scroll is formed at a part of the first protrusion that is close to the first shell, and a second positioning surface for positioning the frame is formed at a part of the second protrusion that is close to the first shell, wherein a recess is formed in a direction to the second shell in at least one of a connecting portion on the first protrusion with the first inner wall surface and a connecting portion on the second protrusion with the second inner wall surface.

* * * * *